US009087482B2

(12) United States Patent
Park et al.

(10) Patent No.: US 9,087,482 B2
(45) Date of Patent: Jul. 21, 2015

(54) OPTICAL COMPENSATION METHOD AND DRIVING METHOD FOR ORGANIC LIGHT EMITTING DISPLAY DEVICE

(71) Applicant: LG Display Co., Ltd., Seoul (KR)

(72) Inventors: Ilkwon Park, Goyang-si (KR); Dongkyoung Oh, Gumi-si (KR); Kyeongsu Mun, Ulsan (KR)

(73) Assignee: LG Display Co., Ltd., Seoul (KR)

( * ) Notice: Subject to any disclaimer, the term of this patent is extended or adjusted under 35 U.S.C. 154(b) by 169 days.

(21) Appl. No.: 13/623,015

(22) Filed: Sep. 19, 2012

(65) Prior Publication Data

US 2013/0070007 A1 Mar. 21, 2013

(30) Foreign Application Priority Data

Sep. 19, 2011 (KR) ..... 10-2011-0094190

(51) Int. Cl.
*G09G 3/32* (2006.01)

(52) U.S. Cl.
CPC ..... *G09G 3/3233* (2013.01); *G09G 2300/0452* (2013.01); *G09G 2320/0666* (2013.01); *G09G 2320/0673* (2013.01); *G09G 2320/103* (2013.01); *G09G 2360/147* (2013.01)

(58) Field of Classification Search
CPC ..... G09G 3/3233; G09G 2300/0452; G09G 2320/0666; G09G 2320/0673; G09G 2320/103; G09G 2360/147
USPC ..... 345/77, 83
See application file for complete search history.

(56) References Cited

U.S. PATENT DOCUMENTS

| | | | | |
|---|---|---|---|---|
| 2004/0222999 | A1* | 11/2004 | Choi et al. | 345/77 |
| 2007/0176862 | A1* | 8/2007 | Kurt et al. | 345/82 |
| 2009/0135123 | A1* | 5/2009 | Yamato et al. | 345/94 |
| 2009/0213048 | A1* | 8/2009 | Park et al. | 345/77 |
| 2009/0219306 | A1* | 9/2009 | Oh et al. | 345/690 |
| 2011/0149166 | A1* | 6/2011 | Botzas et al. | 348/649 |
| 2011/0292087 | A1* | 12/2011 | Lim | 345/76 |

FOREIGN PATENT DOCUMENTS

| | | |
|---|---|---|
| KR | 10-2007-0003937 A | 1/2007 |
| KR | 10-2011-0073376 | 6/2011 |

OTHER PUBLICATIONS

Korean Intellectual Property Office, Office Action, Korean Patent Application No. No. 10-2011-0094190, Dec. 29, 2014, six pages [with concise explanation of relevance in English].

* cited by examiner

*Primary Examiner* — Allison Johnson
(74) *Attorney, Agent, or Firm* — Fenwick & West LLP

(57) ABSTRACT

An optical compensation method for an organic light emitting display device comprises: setting initial gain values of RGB subpixels; making each of the RGB subpixels converge on target luminance; selecting subpixels to emit light with the W subpixel from the RGB subpixels, and setting an initial gain value of the W subpixel; measuring color coordinates and luminance of the W subpixel to which the initial gain value is applied; calculating the luminance ratio of the W subpixel and the selected subpixels; adjusting maximum gains of the W subpixel and the selected subpixels; measuring maximum color coordinates and luminance ratio of the W subpixel and the selected subpixels; and making the W subpixel and the selected subpixels converge on target color coordinates and luminance.

14 Claims, 13 Drawing Sheets

| W | G | B |
|---|---|---|
| 255 | 21 | 120 |
| 223 | 21 | 120 |
| 191 | 21 | 120 |
| 159 | 18 | 115 |
| 127 | 18 | 115 |
| 95 | 18 | 115 |
| 63 | 16 | 110 |
| 31 | 16 | 110 |
| 0 | 0 | 0 |

| W | G | B |
|---|---|---|
| 255 | 25 | 140 |
| 223 | 25 | 140 |
| 191 | 25 | 140 |
| 159 | 25 | 140 |
| 127 | 25 | 140 |
| 95 | 25 | 140 |
| 63 | 25 | 140 |
| 31 | 25 | 140 |
| 0 | 0 | 0 |

OPTICAL COMPENSATION METHOD AND DRIVING METHOD FOR ORGANIC LIGHT EMITTING DISPLAY DEVICE

CROSS-REFERENCE TO RELATED APPLICATION

This application claims priority to Republic of Korea Patent Application No, 10-2011-0094190 filed on Sep. 19, 2011, which is incorporated herein by reference in its entirety.

BACKGROUND

1. Field

The present invention relates to a scan driver and an optical compensation method and driving method for an organic light emitting display device.

2. Description of the Related Art

An organic light emitting element used for an organic light emitting display device is a self-light emitting element which has a light emitting layer formed between two electrodes. In the organic light emitting display device, electrons and holes are injected into the light emitting layer from a electron injection electrode and a hole injection electrode, respectively. The injected electrons and holes are combined to generate excitons, which illuminate when converting from an excited state to a ground state.

In the organic light emitting display device, when scan signals, data signals, and power are supplied to a plurality of subpixels arranged in a matrix, selected subpixels emit light, to display images. Some organic light, emitting display devices have a subpixel structure (hereinafter, abbreviated as RGBW OLED) that includes red, green, blue, and white colors.

The RGBW OLED uses a complicated algorithm (which is equivalent to finding one point on a three-dimensional space) that adjusts three RGB gains. The relationship between gain and luminance of each of RGBW has a different increasing pattern for each gray level, so it is difficult to estimate the common amount of change for converging on target values. Therefore, there is a high possibility of deadlock caused by gain variations because the RGBW OLED commonly uses RGBW gains to adjust color coordinates and luminance.

Moreover, the RGBW OLED drives one of the RGB subpixels to additionally emit light on a display panel in order to correct white coordinates. Accordingly, the power consumption of the RGBW OLED increases as much as the color additionally emits light on the display panel.

SUMMARY

In one embodiment, an optical compensation method for an organic light emitting display device is provided, the method comprising: setting initial gain values of RGB subpixels; making each of the RGB subpixels converge on target luminance; selecting subpixels to emit light with the W subpixel from the RGB subpixels, and setting an initial gain value of the W subpixel; measuring color coordinates and luminance of the W subpixel to which the initial gain value is applied; calculating the luminance ratio of the W subpixel and the selected subpixels; adjusting maximum gains of the W subpixel and the selected subpixels; measuring maximum color coordinates and luminance ratio of the W subpixel and the selected subpixels; and making the W subpixel and the selected subpixels converge on target color coordinates and luminance.

In another embodiment, a driving method for an organic light emitting display device is provided, the method comprising: analyzing an input image to detect whether the input image corresponds to video; if the input image corresponds to video, analyzing the amount of W data signal included in the input, image; determining the amount of data signals selected from RGB data signals according to an analysis result of the amount of W data signal; applying the amount of selected data signals to generate RGBW data signals and outputting the RGBW data signals; and displaying the image by using the RGBW data signals.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF EMBODIMENTS

Reference will now be made in detail embodiments of the invention examples of which are illustrated in the accompanying drawings.

Hereinafter, a concrete exemplary embodiment according to the present invention will be described with reference to the attached drawings.

Figure 1:
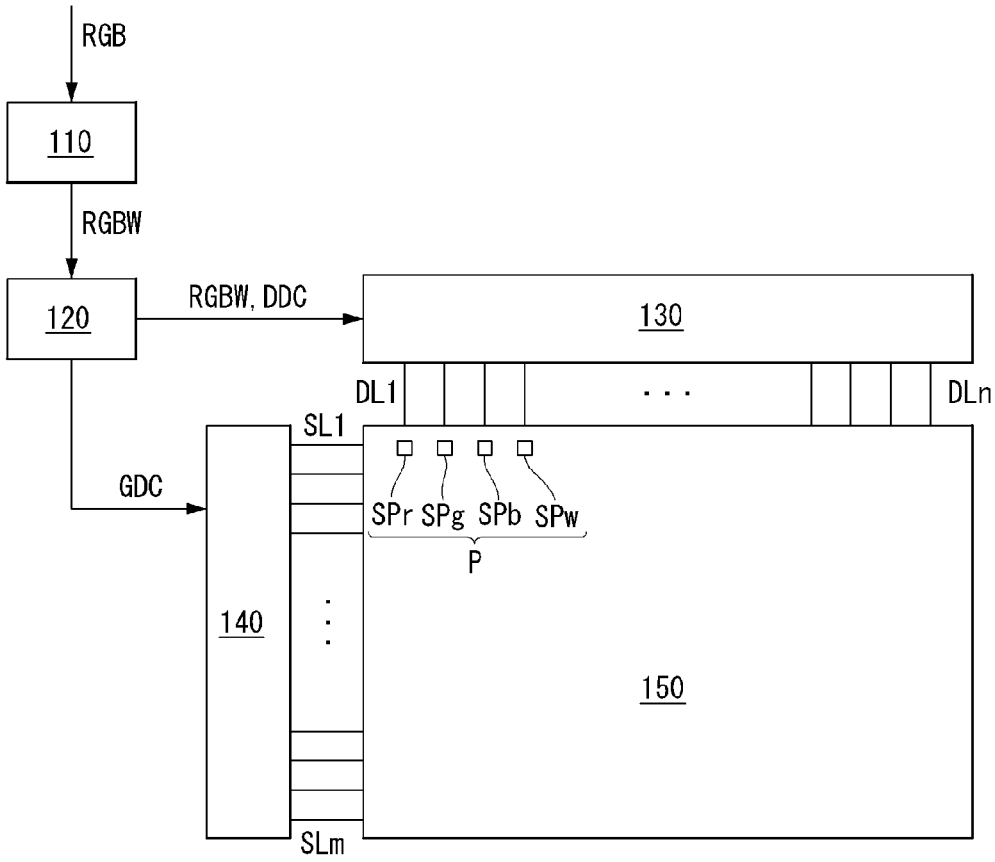
FIG. 1 is a schematic block diagram of an organic light emitting display device according to an exemplary embodiment of the present invention.
Figure 2:
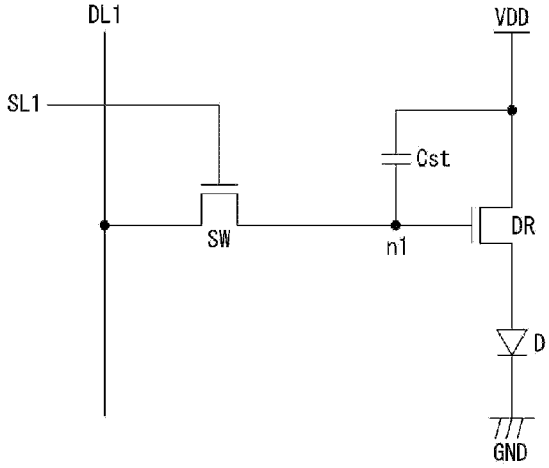
FIG. 2 is an illustration of the circuit configuration of a subpixel.

FIG. 1 is a schematic block diagram of an organic light emitting display device according to an exemplary embodiment of the present invention. FIG. 2 is an illustration of the circuit configuration of a subpixel.

As shown in FIG. 1, the organic light emitting display device according to the exemplary embodiment of the present invention comprises an image processor 110, a timing controller 120, a data driver 130, a scan driver 140, and a display panel 150.

The display panel 150 is formed as an organic light emitting display panel comprising subpixels SPr, SPg, SPb, and SPw arranged in a matrix form. The subpixels SPr, SPg, SPb, and SPw comprise a red subpixel SPr, a green subpixel SPg, a blue subpixel SPb, and a white subpixel SPw, and they form a single pixel P.

As shown in FIG. 2, a subpixel comprises a switching transistor SW, a driving transistor DR, a capacitor Cst, and an organic light emitting diode D. The switching transistor SW is switched on to supply a data signal supplied through a first data line DL1 to a first node n1 and store the data signal as a data voltage in the capacitor Cst, in response to a scan signal supplied through a first scan line SL1. The driving transistor DR is operable to cause driving current to flow between a first power supply terminal VDD and a second power supply terminal GND in response to the data voltage stored in the capacitor Cst. The organic light emitting diode D is operable to emit light in response to the driving current generated by the driving transistor DR.

The subpixels SPr, SPg, SPb, and SPw may have a 2T (Transistor) 1C (Capacitor) structure comprising a switching transistor SW, a driving transistor DR, a capacitor Cst, an organic light emitting diode D, as explained above, or may have a 3T1C structure, a 4T1C structure, a 5T2C structure, and the like, comprising more transistors and capacitors.

The subpixels SPr, SPg, SPb, and SPw having the aforementioned configuration may be formed as top-emission type subpixels, bottom-emission type subpixels, or dual-emission type subpixels. The red subpixel SPr, the green subpixel SPg, and the blue subpixel SPb may be implemented by a method using a color filter based on the white subpixel SPw, a method of forming organic materials included in their organic light emitting diodes D, or the like.

The image processor 110 receives a vertical synchronous signal, a horizontal synchronous signal, a data enable signal, a clock signal, and data signals RGB from an external source. The image processor 110 converts the RGB data signals into RGBW data signals by an image compensation method or the like and supplies them to the timing controller 120. At this point, the image processor 110 adds the W data signal and selected ones of the RGB data signals together to produce RGBW data signals, to correct white coordinates. Then, upon receiving the RGBW data signals, the display panel 150 displays white based on the lighting of the white subpixel SPw and the selected subpixels. The image processor 110 sets a gamma voltage so as to achieve maximum luminance according to average picture level by using the RGB data signals or the RGBW data signals. The image processor 110 is also capable of other various image processing operations.

The timing driver 120 receives a vertical synchronous signal, a horizontal synchronous signal, a data enable signal, a clock signal, and data signals from the image processor 110. The timing controller 120 controls an operational timing of the data driver 130 and the scan driver 140 by using the timing signals such as the vertical synchronous signal, the horizontal synchronous signal, the data enable signal, and the clock signal. In this case, because the timing driver 120 can determine a frame period by counting the data enable signal during one horizontal period, the vertical synchronous signal and the horizontal synchronous signal, which are supplied from an external source, may be omitted. Control signals generated by the timing driver 120 may comprise a gate timing control signal GDC for controlling an operational timing of the scan driver 140 and a data timing control signal DDC for controlling an operational timing of the data driver 130. The gate timing control signal GDC comprises a gate start pulse, a gate shift clock, and a gate output enable signal. The data timing control signal DDC comprises a source start pulse SSP, a source sampling clock SSC, and a source output enable signal SOE.

The scan driver 140 sequentially generates scan signals while shifting the levels of the signals with a swing width of a gate driving voltage with which the transistors of the subpixels SPr, SPg, SPb, and SPw included in the display panel 150 can operate in response to the gate timing control signal GDC provided from the timing controller 120. The scan driver 140 supplies the generated scan signals through scan lines SL1 to SLm to the subpixels SPr, SPg, SPb, and SPw included in the display panel 150.

In response to the data timing control signal DDC provided from the timing controller 120, the data driver 130 samples the RGBW data signals supplied from the timing controller 120 and latches the same to convert them into data of a parallel data system. In converting the signals into the data of a parallel data system, the data driver 130 converts the digital RGBW data signals into analog data signals in response to a gamma voltage. The conversion of the digital data signals into analog data signals is performed by a digital-to-analog converter DAC included in the data driver 130. The data driver 130 supplies the converted RGBW data signals to the subpixels SPr, SPg, SPb, and SPw included in the display panel 150 through the data lines DL1 to DLn.

Figure 3:
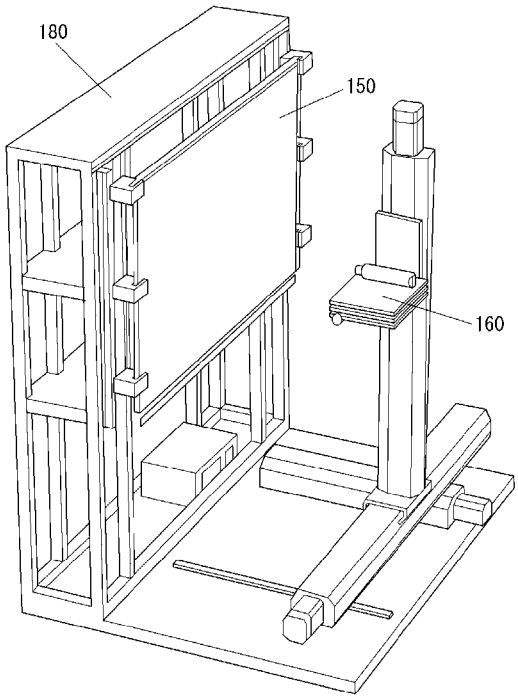
FIG. 3 is a view showing the schematic configuration of an instrument for performing optical compensation on an organic light emitting display device.
Figure 4:
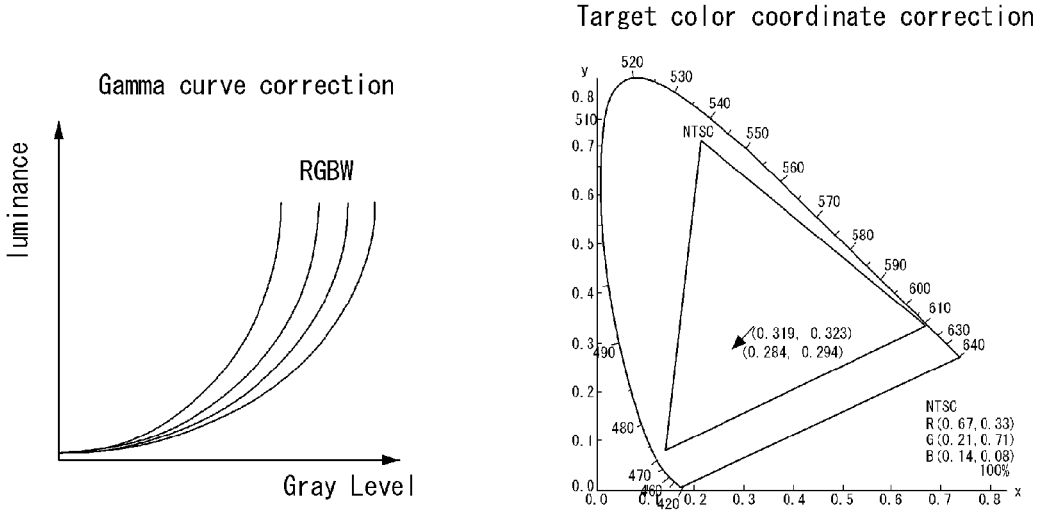
FIG. 4 is a view for explaining gamma curve correction and target color coordinate correction in terms of display panel when optical compensation is performed.
Figure 5:
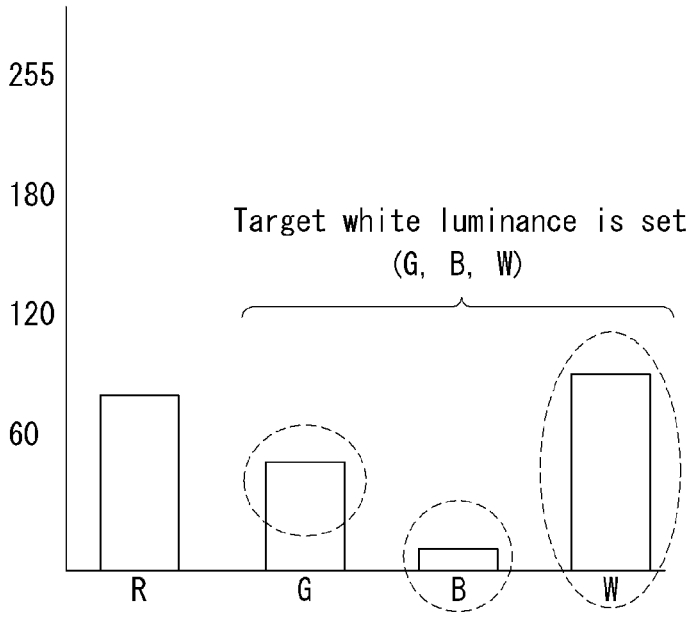
FIG. 5 is a view for explaining target white luminance set in terms of data signals when optical compensation is performed.

FIG. 3 is a view showing the schematic configuration of an instrument for performing optical compensation on an organic light emitting display device. FIG. 4 is a view for explaining gamma curve correction and target color coordinate correction in terms of display panel when optical compensation is performed. FIG. 5 is a view for explaining target white luminance set in terms of data signals when optical compensation is performed.

As shown in FIG. 3, optical compensation on the organic light emitting display device is performed by a measuring instrument 160 for measuring luminance from the display panel 150 held by a holder 180. The measuring instrument 160 measures the luminance of each of the RGBW subpixels displayed on the display panel 150 and the white luminance of these subpixels. A value measured by a measuring unit of the measuring instrument 160 is displayed on a monitor or the like working in conjunction with the measuring unit. An operator performing optical compensation adjusts gains based on a luminance ratio calculation while observing whether the measured value displayed on the monitor or the like corresponds to a target value, and performs measurement, setup, and adjustment operations so that the measured value reaches the target value.

As shown in FIG. 4, when operations accompanied by optical compensation are performed, a gamma curve showing luminance versus gray level for RGBW appears on the display panel. The operator corrects the target color coordinates by gamma curve adjustment. Since preferred target color coordinates differ according to consumers (or countries), the optical compensation operation is determined according to consumer preferences. Therefore, the optical compensation operation requires a fast and efficient method which offers the accuracy of compensation.

As shown in FIG. 5, once the target white luminance is set, selected subpixels, e.g., GB subpixels GB, as shown in the drawing, as well as the W subpixel, need to emit light on the display panel.

That is, as explained with reference to FIG. 1, as for the RGBW subpixels SPr, SPg, SPb, and SPw, subpixels selected from the RGB subpixels SPr, SPg, and SPb needs to emit light with the W subpixel SPw on the display panel 150.

As such, the target white luminance of the display panel of the embodiment consists of not a single color but a combination of multiple colors.

Because of this characteristic, when optical compensation is performed on the organic light emitting display device according to the conventional optical compensation method, the relationship between the gain and luminance of each of the RGBW subpixels SPr, SPg, and SPb shows a different increasing pattern for each gray level. Due to this, it is difficult to estimate the common amount of change for converging the color coordinates and luminance of these subpixels on target values by using the conventional optical compensation method. Also, the conventional optical compensation method may arouse deadlock due to gain variations for adjusting the color coordinates and luminance of these subpixels. Therefore, the following optical compensation method according to the embodiments herein may be used in order to avoid such deadlock and perform fast and efficient optical compensation with accuracy.

First Exemplary Embodiment

Hereinafter, an optical compensation method for an organic light emitting display device according to a first exemplary embodiment will be described in more detail.

Figure 6:
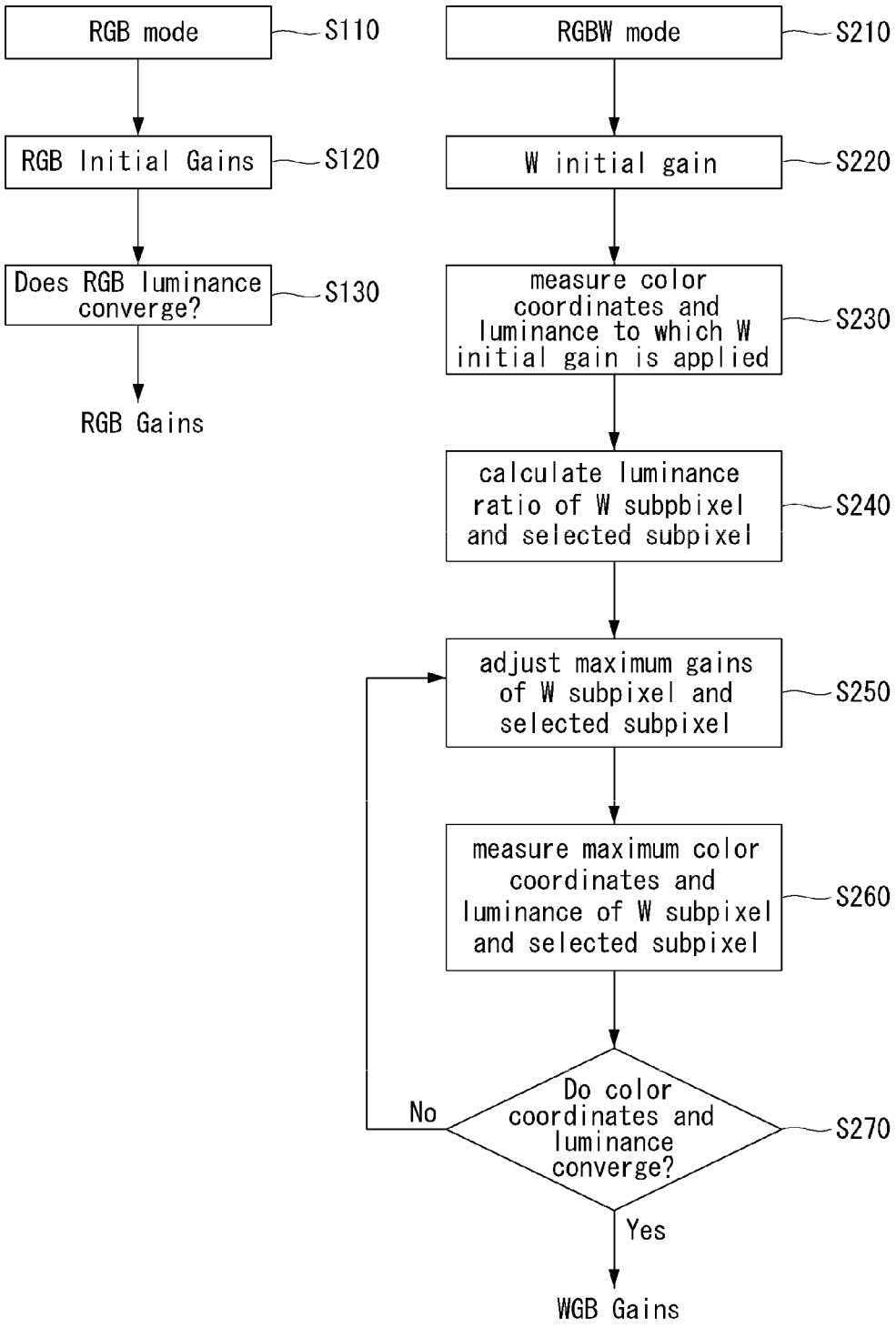
FIG. 6 is a flowchart for explaining a schematic flow of an optical compensation method for an organic light emitting display device according to a first exemplary embodiment.
Figure 7:
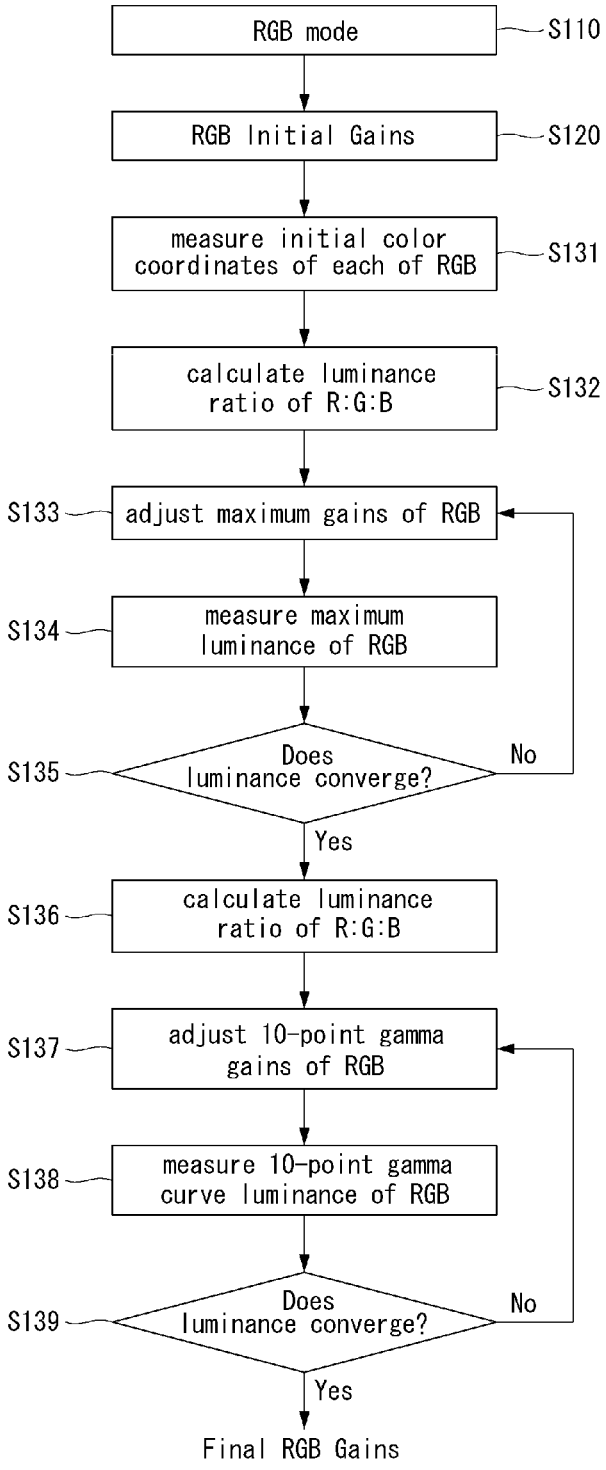
FIGS. 7 to 10 illustrate in detail the optical compensation method for the organic light emitting display device according to the first exemplary embodiment and the resulting luminance curves.
Figure 8:
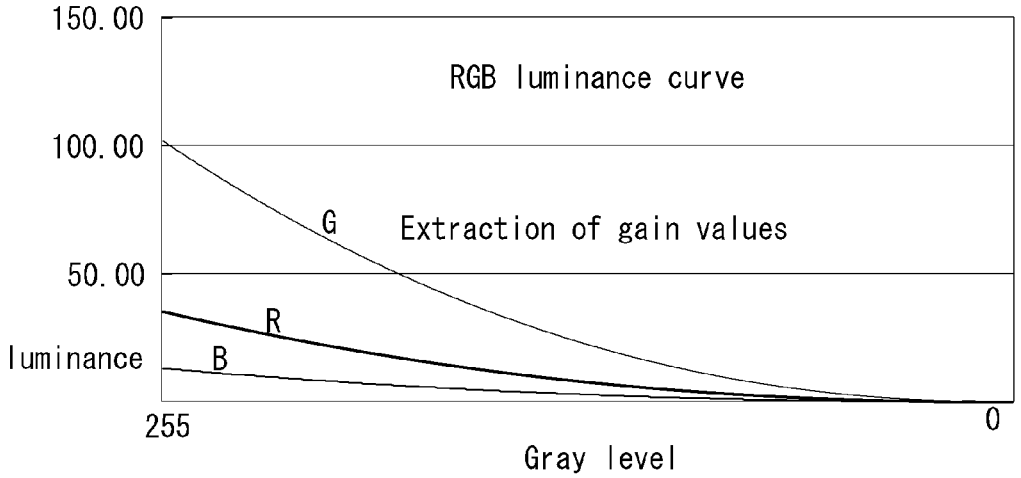
Figure 9:
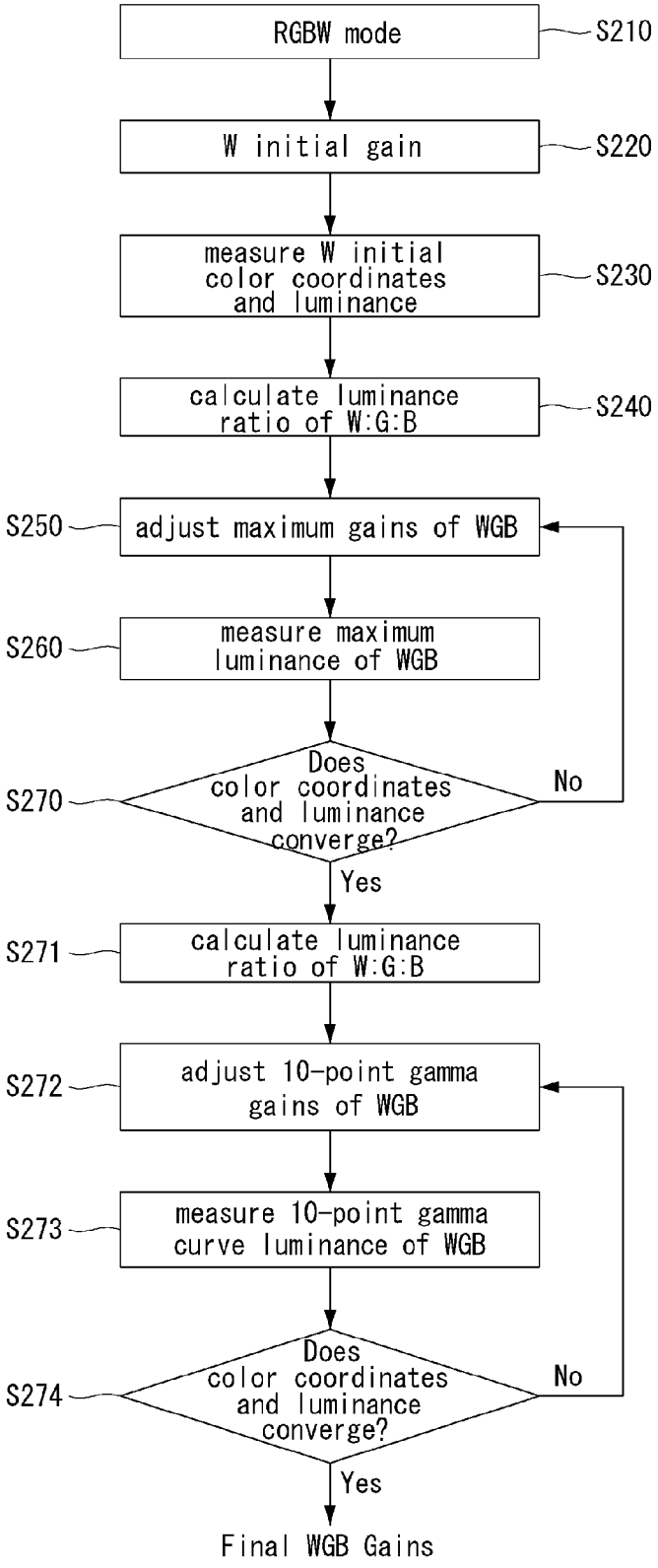
Figure 10:
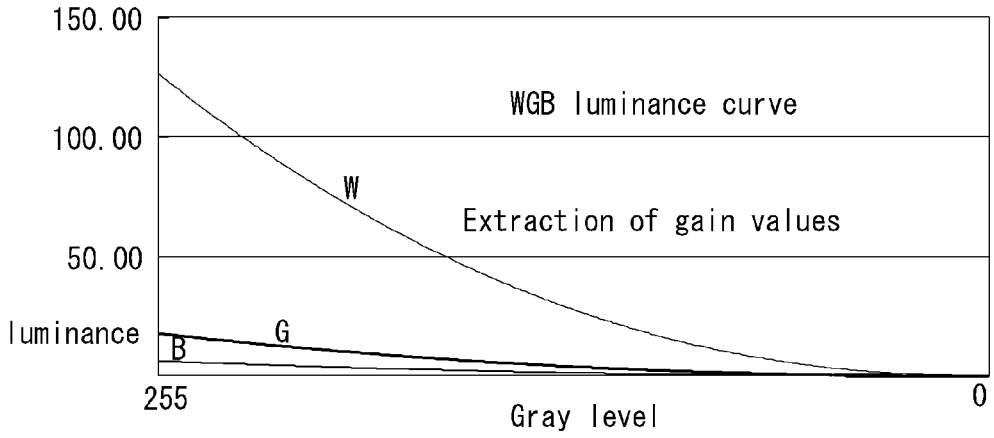

FIG. 6 is a flowchart for explaining a schematic flow of an optical compensation method for an organic light emitting display device according to a first exemplary embodiment.

As shown in FIG. 6, the schematic flow of the optical compensation method for the organic light emitting display device according to the first exemplary embodiment of the present invention will be described below.

A display mode of a display panel is set to an RGB mode (S110). RGB initial gains of RGB subpixels are set (S120). Each of the RGB subpixels converges on target luminance (S130). The display mode of the display panel is set to an RGBW mode (S210). Subpixels to emit light together with a W subpixel are selected from the RGB subpixels, and a W initial gain of the W subpixel is set (S220). The color coordinates and luminance of the W subpixel to which the initial gain value is applied are measured (S230). The luminance ratio of the W subpixel and the selected subpixels is calculated (S240). Maximum gains of the W subpixel and the selected subpixels are adjusted (S250). Maximum color coordinates and luminance of the W subpixel and the selected subpixels are measured (S260). The W subpixel and the selected subpixels converge on target color coordinates and luminance (S270).

In the above process, the number of selected subpixels may be one, two, or three selected from the RGB subpixels, the reason of which is as follows. The number of selected subpixels that additionally emit light on the display panel in order to represent target color coordinates and luminance for white may be one, two, or three of the RGB subpixels depending on images. If two subpixels are selected, the selected subpixels that additionally emit light in order to represent the target color coordinates and luminance for white may be either GB subpixels, RG subpixels, or RB subpixels.

In the above process, in the step S270 of making the color coordinates and luminance of the W subpixel and the selected subpixels converge in the RGBW mode, as well as in the step S130 of making the luminance of the RGB subpixels converge in the RGB mode, measurement and adjustment are done more than once. For example, if the W subpixel and the selected subpixels converge on the target color coordinates and luminance (Yes), gain values of the W subpixel and the selected subpixels are extracted. However, if the W subpixel and the selected subpixels do not converge on the target color coordinates and luminance (No), the process subsequent the step S250 of adjusting maximum gains of the W subpixel and the selected subpixels is repeated.

The step S130 of making the luminance of the RGB subpixels converge in the RGB mode is divided into a step for making the luminance of the R subpixel converge, a step for making the luminance of the G subpixel converge, and a step for making the luminance of the B subpixel converge. Likewise, the step S270 of making the color coordinates and luminance of the W subpixel and the selected subpixels converge in the RGBW mode is also divided into a step making the luminance of the W subpixel converge and a step for making the luminance of the selected subpixels converge.

Hereinafter, the optical compensation method for the organic light emitting display device according to the first exemplary embodiment of the present invention will be described in more detail by taking as an example the case where the selected subpixels to emit light together with the W subpixel are the GB subpixels.

FIGS. 7 to 10 are flowcharts for explaining in detail the optical compensation method for the organic light emitting display device according to the first exemplary embodiment of the present invention and the resulting luminance curves.

First, the display mode of the display panel is set to the RGB mode (S110). Since the display panel of the first exemplary embodiment is capable of displaying all of RGBW, only RGB data signals are used as test signals to display only RGB, and the display panel is configured to display an image.

Next, RGB initial gains of RGB subpixels are set (S120). In this step, data is written in a lookup table working in conjunction with a gamma unit so that an image is displayed on the display panel based on the initial gains of the RGB subpixels.

Next, the color coordinates and luminance of each of the RGB subpixels to which the initial gain values are applied are measured (S131).

Next, the luminance ratio of the RGB subpixels is calculated (S132). In the step S131 of measuring the color coordinates of each of the RGB subpixels, if the color coordinates of each of the RGB subpixels to which the initial gain values are applied are measured by using a measuring unit, the color coordinate values XYZ for the RGB subpixels are displayed on a monitor or the like. In this step, the operator can thus calculate luminance ratio by using the color coordinate values XYZ. In this step, the operator can calculate the luminance ratio of the RGB subpixels by substituting the measured color coordinate values XYZ into the following Equation 1, but the present invention is not limited thereto.

$$\begin{pmatrix} rL \\ gL \\ bL \end{pmatrix} = \begin{pmatrix} rX & gX & bX \\ rY & gY & bY \\ rZ & gZ & bZ \end{pmatrix}^{-1} \times \begin{pmatrix} wX \\ wY \\ wZ \end{pmatrix} \quad \text{(Equation 1)}$$

The above Equation 1 is a conversion equation for calculating the luminance (L) ratio of the RGB subpixels r, g, and b.

Next, maximum gains of the RGB subpixels are adjusted (S133). Once the luminance ratio of the RGB subpixels is calculated in the luminance ratio calculation S132, the operator adjusts the maximum gains of the RGB subpixels on the system based on the calculated luminance ratio. Then, an image to which the maximum gains are applied is displayed on the display panel.

Next, the maximum luminance of each of the RGB subpixels is measured (S134). In this step, when the maximum luminance of each of the RGB subpixels is measured by using a measuring unit, the measured values are displayed on a monitor or the like. Then, the operator can determine whether the measured maximum luminance values are within the range of luminance convergence.

Next, if the RGB subpixels do not converge on the target luminance (No), the process subsequent to the step S133 of adjusting maximum gains of the RGB subpixels is repeated, and the measured maximum luminance values are adjusted to fall within the range of luminance convergence. Upon completion of the RGB subpixels' converging on the target luminance (Yes), the final RGB gains of the RGB subpixels can be extracted in this step (S135). Otherwise, the subsequent steps are performed.

Next, the luminance ratio of the RGB subpixels is calculated (S136). In this step, the luminance ratio of the RGB subpixels can be calculated by substituting the maximum luminance measured in the maximum luminance measuring step S134 into Equation 1, but the present invention is not limited thereto.

Next, the gains of the RGB subpixels are adjusted for each point (S137). In this step, the gains of the RGB subpixels can be adjusted for M gamma adjustment points (M is an integer equal to or greater than 2) such as 2, 4, 6, 8, 10, and 12, but the present invention is not limited thereto. In the first exemplary embodiment, 10-point gamma gains are adjusted by way of example.

Next, the per-point gamma curve luminance is measured for each of the RGB subpixels (S138). Since the 10-point gamma gains have been adjusted in the step S137 of adjusting gains for each point, the corresponding 10-point gamma curve luminance is measured in this step. However, this step may vary depending on gamma gain adjustment points.

Next, if the per-point gamma curve luminance of each of the RGB subpixels does not converge on the target color coordinates and luminance (No), the process subsequent to the step S137 of adjusting gains of the RGB subpixels for each point is repeated, and the target luminance for the per-point gamma curve luminance is adjusted to fall within the range of luminance convergence. Upon completion of the RGB subpixels' converging on the target luminance (Yes), the final RGB gains of the RGB subpixels can be extracted in this step.

Once the RGB subpixels' converging on the target luminance is completed and the final RGB gains of the RGB subpixels are extracted, the display mode of the display panel is set to the RGBW mode (S210).

Next, subpixels (e.g., GB subpixels) to emit light together with the W subpixel are selected from the RGB subpixels, and a W initial gain of the W subpixel is set (S220). Data is written in a lookup table working in conjunction with a gamma unit so that an image is displayed on the display panel based on the initial gains of the RGB subpixels. In this step, the previously extracted final RGB gains, as well as the initial gain of the W subpixel, can be set.

Next, the color coordinates and luminance of the W subpixel to which the initial gain value is applied are measured (S230). The luminance ratio of the W subpixel and the selected subpixels is calculated (S240).

In the step S230 of measuring the color coordinates and luminance of the W subpixel, if the color coordinates and luminance of the W subpixel to which the initial gain values are applied are measured by using a measuring unit, the color coordinate and luminance values XYZ and w for the W subpixel are displayed on a monitor or the like. In this step, the operator can thus calculate the luminance ratio of the W subpixel and the GB subpixels by using the measured color coordinate and luminance values XYZ and w. In this step, the operator can calculate the luminance ratio of the WGB subpixels by substituting the measured color coordinate and luminance values XYZ and w into the following Equation 2, but the present invention is not limited thereto.

$$\begin{pmatrix} wdL \\ gL \\ bL \end{pmatrix} = \begin{pmatrix} wdX & gX & bX \\ wdY & gY & bY \\ wdZ & gZ & bZ \end{pmatrix}^{-1} \times \begin{pmatrix} wX \\ wY \\ wZ \end{pmatrix} \quad \text{(Equation 2)}$$

The above Equation 2 is a conversion equation for calculating the luminance (L) ratio of the WOE subpixels w g, and b. d may be a variable or constant value for the W subpixel.

Next, maximum gains of the WGB subpixels are adjusted (S250). Once the luminance ratio of the WGB subpixels is calculated in the luminance ratio calculation step S240, the operator adjusts the maximum gains of the WGB subpixels on the system based on the calculated luminance ratio. Then, an image to which the maximum gains are applied is displayed on the display panel.

Next, the maximum luminance of each of the W subpixel and the GB subpixels is measured (S260). In this step, when the maximum color coordinates and luminance of each of the WGB subpixels is measured by using a measuring unit, the measured values are displayed on a monitor or the like. Then, the operator can determine whether the measured maximum color coordinate and luminance values are within the range of luminance convergence.

Next, if the W subpixel and the GB subpixels do not converge on the target luminance (No), the process subsequent to the step S255 of adjusting maximum gains of the W subpixel and the GB subpixels is repeated, and the measured maximum color coordinate and luminance values are adjusted to fall within the range of luminance convergence. Upon completion of the WGB subpixels' converging on the target luminance (Yes), the final RGB gains of the WGB subpixels can be extracted in this step (S270). Otherwise, the subsequent steps are performed.

Next, the luminance ratio of the W subpixel and the GB subpixels is calculated (S271). In this step, the luminance ratio of the WGB subpixels can be calculated by substituting the maximum color coordinates and luminance measured in the maximum luminance measuring step S260 into the following Equation 2, but the present invention is not limited thereto.

Next, the gains of the W subpixel and the GB subpixels are adjusted for each point (S272). In this step, the gains of the WGB subpixels can be adjusted for M gamma adjustment points (M is an integer equal to or greater than 2) such as 2, 4, 6, 8, 10, and 12, but the present invention is not limited thereto. In the first exemplary embodiment, 10-point gamma gains are adjusted by way of example.

Next, the per-point gamma curve luminance is measured for each of the W subpixel and the GB subpixels (S273). Since the 10-point gamma gains have been adjusted in the step S272 of adjusting gains for each point, the corresponding 10-point gamma curve luminance is measured in this step. However, this step may vary depending on gamma gain adjustment points.

Next, if the per-point, gamma curve luminance of each of the W subpixel and the GB subpixels do not converge on the target color coordinates and luminance (No), the process subsequent to the step S272 of adjusting gains of the W subpixel and the GB subpixels for each point is repeated, and the target color coordinates and luminance for the per-point gamma curve luminance are adjusted to fall within the range of luminance convergence. Upon completion of the WGB subpixels' converging on the target color coordinates and luminance (Yes), the final WGB gains of the WGB subpixels can be extracted in this step.

FIGS. 11 to 14 are graphs showing optical compensation results according to the first exemplary embodiment of the present invention.

Figure 11:
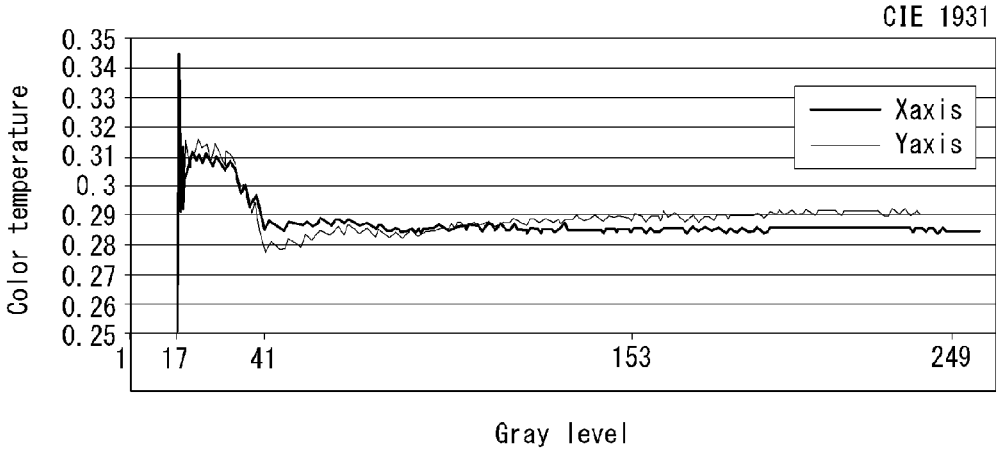
FIGS. 11 to 14 are graphs showing optical compensation results according to the first exemplary embodiment.
Figure 12:
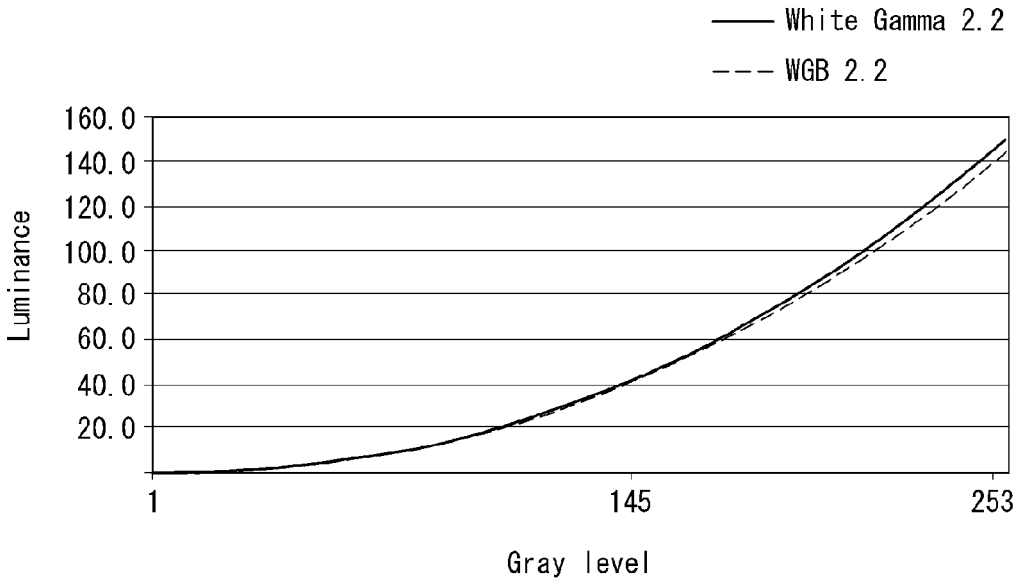
Figure 13:
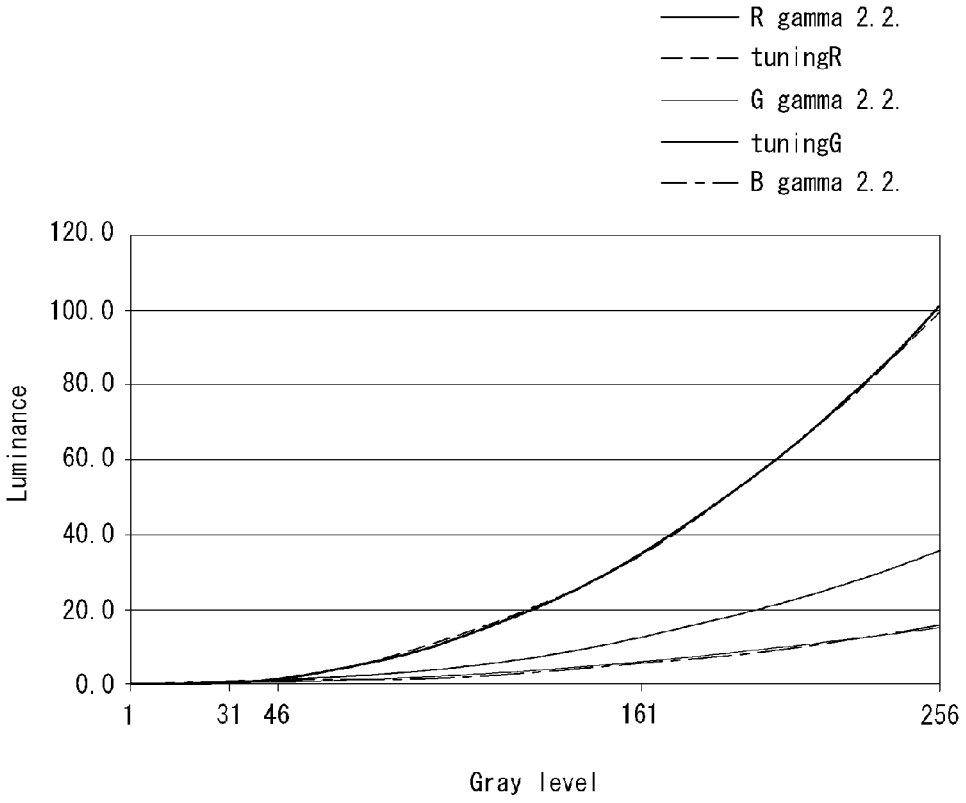
Figure 14:
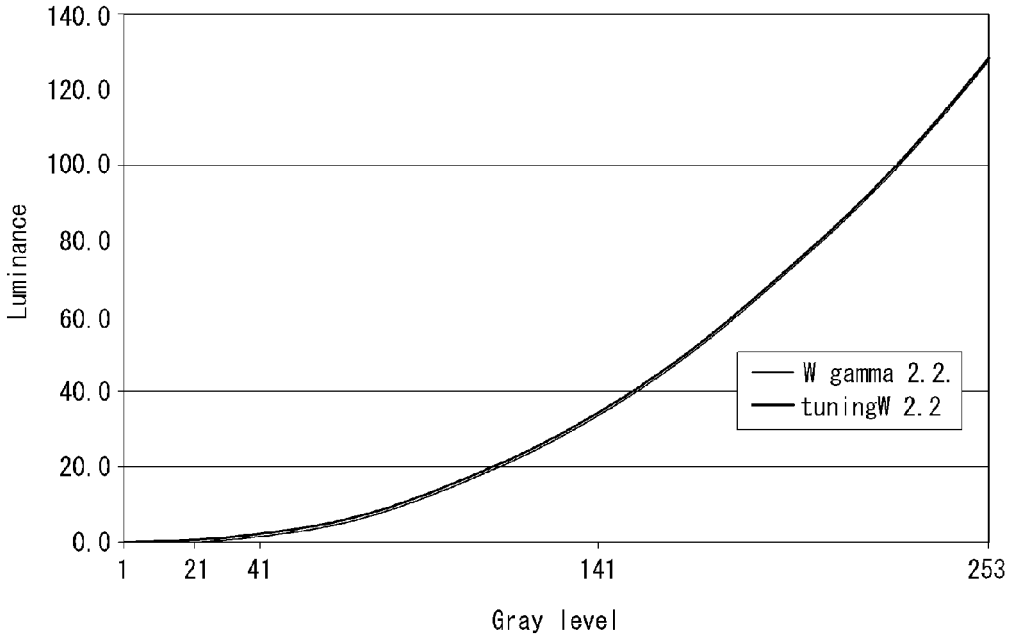

Using the optical compensation method for the organic light, emitting display device according to the first exemplary embodiment of the present invention, the white color coordinates (the X-axis represents gray level, and the Y-axis represents the X and Y coordinates on the color coordinates) as shown in FIG. 11 can be set. And, using the optical compensation method for the organic light emitting display device according to the first exemplary embodiment of the present invention, a luminance curve (the X-axis represents gray level, and the Y-axis represents the X and Y coordinates on the color coordinates) for a gamma of 2.2 as shown in FIG. 12 can be set. And, using the optical compensation method for the organic light emitting display device according to the first exemplary embodiment of the present invention, the luminance (the X-axis represents gray level, and the Y-axis represents luminance) of each of RGB for a gamma of 2.2 as shown in FIG. 13 can be tuned. And, using the optical compensation method for the organic light emitting display device according to the first exemplary embodiment of the present invention, the W luminance (the X-axis represents gray level, and the Y-axis represents luminance) for a gamma of 2.2 as shown in FIG. 14 can be tuned.

As seen above, the first exemplary embodiment of the present invention has the effect of providing an optical compensation method for an organic light emitting display device which automatically calculates and compensates an additional amount of luminescence of the RGB subpixels for white balancing of the W subpixel in the display panel comprising the RGBW subpixels. Also, the first exemplary embodiment of the present invention has the effect of providing an optical compensation method for an organic light emitting display device which offers accuracy and performs a fast and efficient optical compensation, without getting into a deadlock state when a variation in the gain values of gammas of the RGBW subpixels occurs in the display panel comprising the RGBW subpixels. Also, the first exemplary embodiment of the present invention has the effect of providing an optical compensation method for an organic light emitting display device which offers accuracy and performs a fast and efficient optical compensation in the display panel comprising the RGBW subpixels.

The above-explained display panel comprising the RGBW subpixels causes a subpixel selected from the RGB subpixels to further emit light to correct the white color coordinates. Due to this, the display panel comprising the RGBW subpixels is accompanied by an increase in power consumption depending on the amount of selected subpixels upon correcting the white color coordinates. The following driving method is used to solve this problem.

Second Exemplary Embodiment

Figure 15:
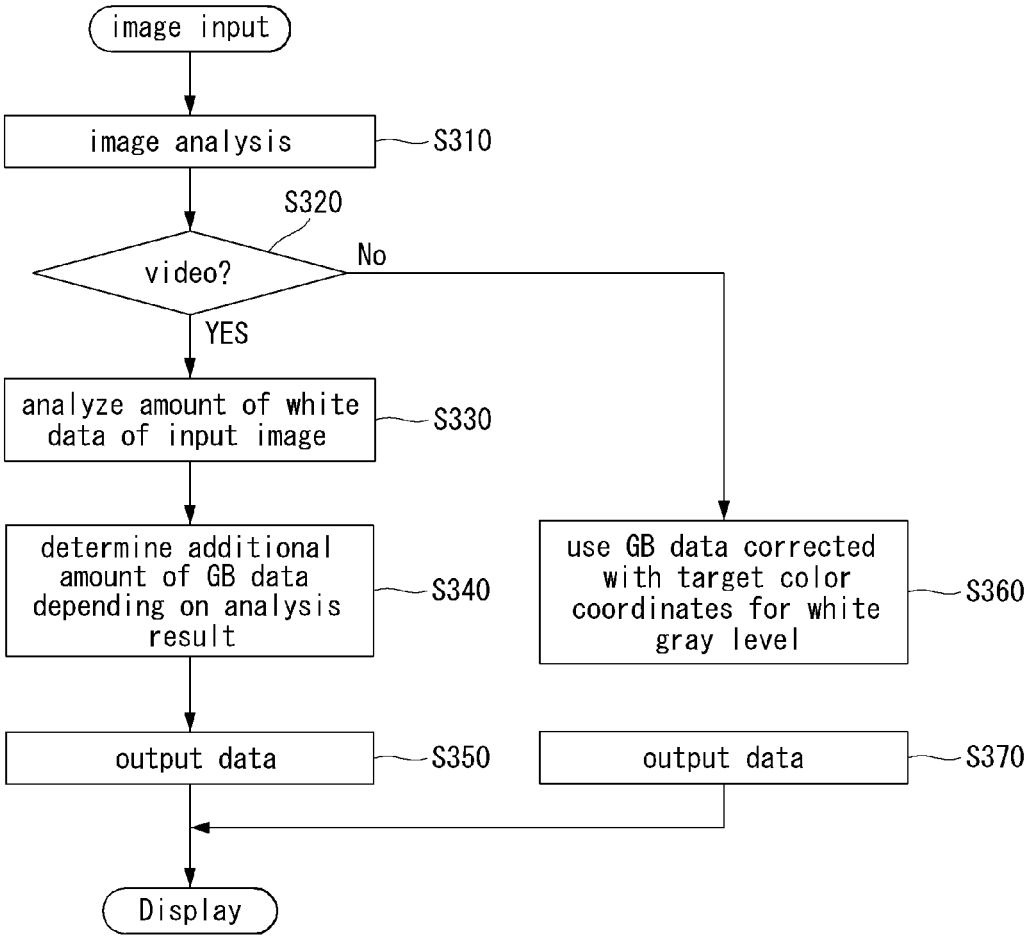
FIG. 15 is a flowchart for explaining a driving method for an organic light emitting display device according to a second exemplary embodiment.
Figure 16:
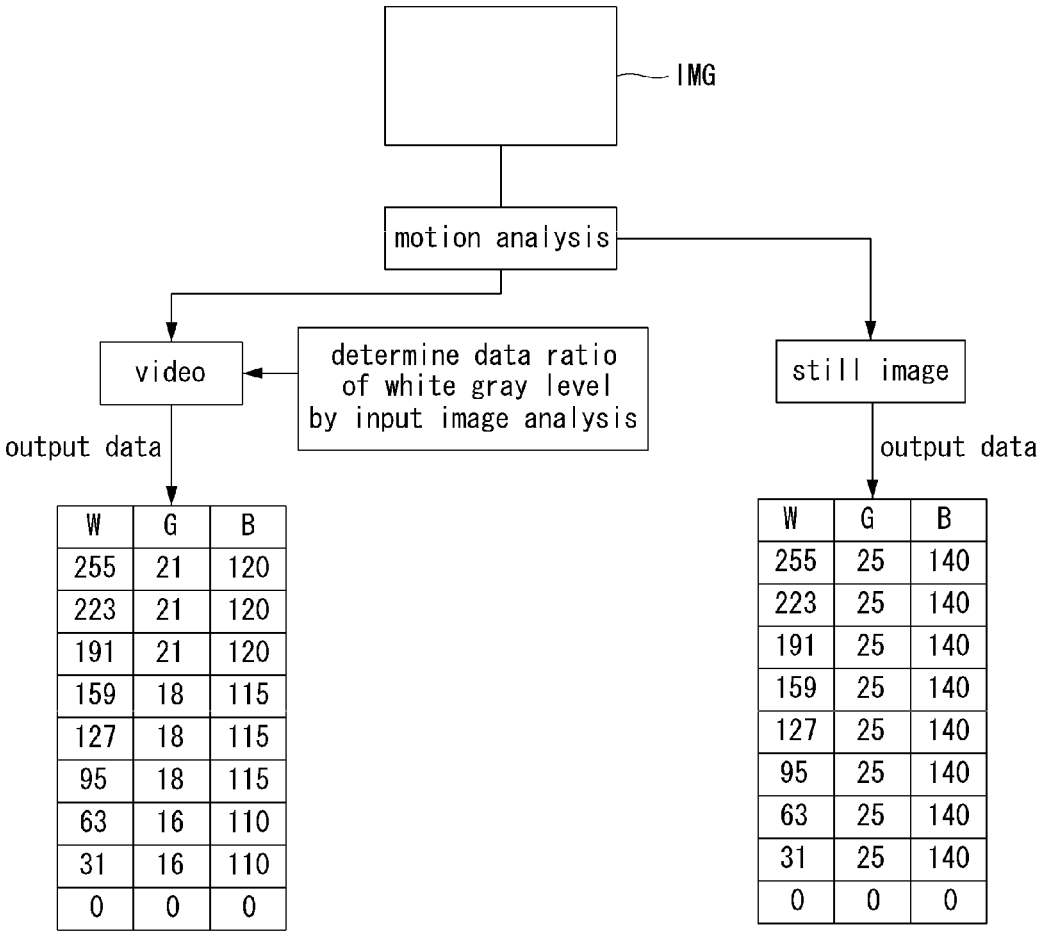
FIG. 16 is a view for showing the data ratio of WGB included in video and a still image in terms of data.
Figure 17:
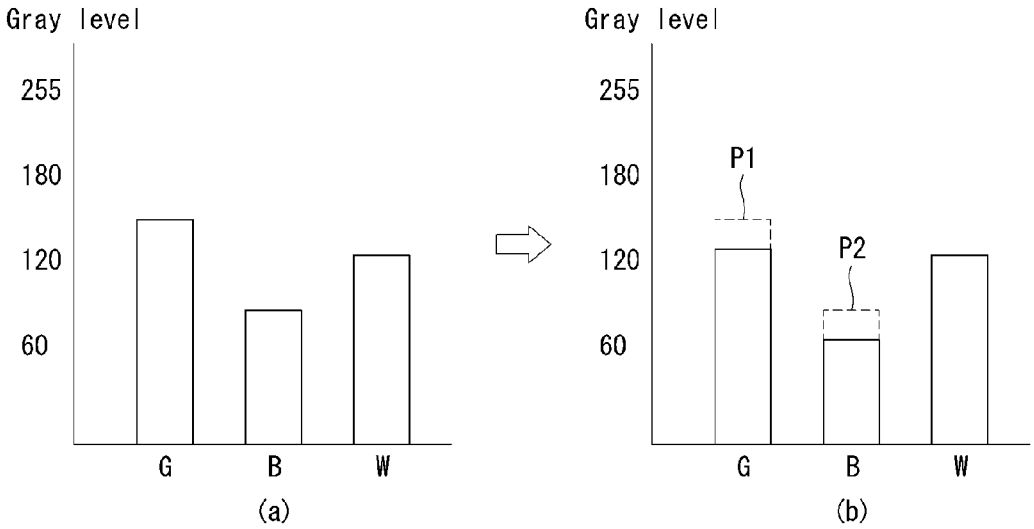
FIG. 17 is a view for showing the data ratio of WGB included in video and a still image in terms of display panel.

FIG. 15 is a flowchart for explaining a driving method for an organic light emitting display device according to a second exemplary embodiment of the present invention. FIG. 16 is a view for showing the data ratio of WGB included in video and a still image in terms of data. FIG. 17 is a view for showing the data ratio of WGB included in video and a still image in terms of display panel.

As shown in FIG. 15, the driving method for the organic light, emitting display device according to the second exemplary embodiment of the present invention comprises an image analysis step S310, a video detection step S320, a W data signal amount analysis step S330, a selected data signal amount determination step S340, a data signal output step S350, a reference amount determination step S360, and a data signal output step S370.

Also in the second exemplary embodiment, as explained with reference to FIG. 1, data signals selected from RGB data signals and a W data signal are added together to produce RGBW data signals to correct white color coordinates. Then, upon receiving the RGBW data signals, the display panel 150 displays white based on the lighting of the white subpixel SPw and selected subpixels.

Therefore, the number of selected subpixels may be one, two, or three selected from the RGB data signals, the reason of which is as follows. The number of selected data signals that additionally emit light on the display panel of the second exemplary embodiment in order to represent target color coordinates and luminance for white may be one, two, or three of the RGB data signals depending on images. If two data signals are selected, the selected data signals that additionally emit light in order to represent the target color coordinates and luminance for white may be either GB data signals, RG data signals, or RB data signals.

For convenience of explanation, the following description will be made on an example where the selected data signals to emit light together with the W data signal are GB data signals.

First of all, an input image is analyzed to detect whether the image corresponds to video (S310). The image analysis step S310 is performed by an image processor. The image processor detects whether the image is video or still based on the amount of change in each frame of data signals included in the input image and a motion in the input image (S320).

Next, if the input image corresponds to video (Yes), the amount of W data signal is analyzed (S330). If the input image corresponds to video, the image processor analyzes the amount of W data signal and calculates an analysis result.

Next, the amount of GB data signals is determined depending on the analysis result of the amount of W data signal (S340). In the selected data signal amount determination step S340, the amount of GB data signals is determined to be increased and decreased relative to the reference amount depending on the amount of W data signal. The reference amount refers to a value prepared by the use of GB data signals corrected with the target color coordinates for white gray level, that is, by optical compensation, which may be a normal value based on a lookup table for determining the amount of GB data signals for each gray level. The previously explained first exemplary embodiment is applicable to the optical compensation method.

In the selected data signal amount determination step S340, if the amount of W data signal is small as an analysis result of the amount of W data signal, the amount of GB data signals is decreased compared to the reference amount. On the contrary, if the amount of W data signal is large, the amount of GB data signals is increased compared to the reference amount.

By increasing and decreasing the amount of GB data signals, which are the selected data signals, it is possible to solve the problem of an increase in power consumption accompanied by the overall amount of selected data signals to be additionally emit light.

Next, by applying the amount of GB data signals, RGBW data signals are generated and output (S350). The image processor determines the amount of GB data signals depending on an analysis result of the amount of W data signal, and applies this amount to generate RGBW data signals and output them through a timing controller. The timing controller supplies the RGBW data signals to the display panel. Then, the display panel displays an image using the RGBW data signals.

On the other hand, if the input image does not correspond to video (NO), the amount of GB data signals is determined to be a reference amount corrected with the target color coordinates for white gray level (S360).

Next, by applying the amount of GB data signals, RGBW data signals are generated and output (S370). If the input image is not video, the image processor determines the amount of GB data signals based on the value corrected with the target color coordinates for white gray level, that is, the reference amount set in the lookup table, and applies this amount to generate RGBW data signals and outputs them through the timing controller.

By varying the amount of selected data signals in the same manner as in the second exemplary embodiment, the amount of selected data signals is decreased as in the following example.

As shown in FIG. 16, when an image IMG is input, the image processor analyzes a motion, and detects whether the image IMG is video or still. Also, if the image IMG is still, an amount of GB data signals set in the lookup table is set and output. On the contrary, if the image IMG is video, an amount of GB data signals which is lower than the reference amount is set and output. This is demonstrated in the GB output for the video and the GB output for the still image.

Although FIG. 16 shows the data ratio of WGB included in video and a still image in terms of data, this figure will be shown below in terms of display panel.

As shown in FIG. 17, if the image IMG is a still image (a), GB subpixels in the display panel emit light by a reference amount of GB data signals. On the contrary, if the image IMG is video (b), the GB subpixels in the display panel emit light by an amount of GB data signals which is lower than the reference amount. This is represented as reductions in gray level at portions "P1" and "P2" of FIG. 17.

According to the second exemplary embodiment, in the above-explained driving method, the amount of selected data signals has a larger reduction relative to the reference amount when the images corresponding to video have a lower gray level.

A description of which will be easily understood with reference to the following Tables 1 and 2 according to the second exemplary embodiment, as compared to Comparative Example.

The following Table 1 shows an example where GB data signals corresponding to an input image are reduced by 5% at 32 gray levels, as compared to Comparative Example.

TABLE 1

| | Comparative Example | | Second exemplary embodiment | | |
|---|---|---|---|---|---|
| | G | B | G | B | Note |
| 255G | 91 | 167 | 91 | 167 | — |
| 223G | 91 | 167 | 87 | 159 | 223G * 0.95 |
| 191G | 91 | 167 | 82 | 151 | 191G * 0.90 |
| 159G | 91 | 167 | 78 | 142 | 159G * 0.85 |
| 127G | 91 | 167 | 73 | 134 | 127G * 0.80 |
| 95G | 91 | 167 | 69 | 126 | 95G * 0.75 |
| 63G | 91 | 167 | 64 | 117 | 63G * 0.70 |
| 31G | 91 | 167 | 60 | 109 | 31G * 0.65 |

The following Table 2 shows an example where GB data signals corresponding to an input image are reduced by 10% at 32 gray levels, as compared to comparative Example.

TABLE 2

| | Comparative Example | | Second exemplary embodiment | | |
|---|---|---|---|---|---|
| | G | B | G | B | Note |
| 255G | 91 | 167 | 91 | 167 | — |
| 223G | 91 | 167 | 82 | 151 | 223G * 0.9 |
| 191G | 91 | 167 | 73 | 134 | 191G * 0.8 |
| 159G | 91 | 167 | 64 | 117 | 159G * 0.7 |
| 127G | 91 | 167 | 55 | 101 | 127G * 0.6 |
| 95G | 91 | 167 | 46 | 84 | 95G * 0.5 |
| 63G | 91 | 167 | 37 | 67 | 63G * 0.4 |
| 31G | 91 | 167 | 28 | 51 | 31G * 0.3 |

Meanwhile, in the second exemplary embodiment, the following current consumption values are obtained from the simulation of the accumulated current of a 10-minute, international standard video in the experimental process.

Comparative Example: 136.57W

Second Exemplary Embodiment of Table 1: 124.77W (91.3%)

Second Exemplary Embodiment of Table 2: 112.65W (82.5%)

From the above experimental results, gray levels and colors continue to change, and color coordinate distortions are less detected at low gray levels. Due to this, even with the use of the driving method as in the second exemplary embodiment, it could be expected that it will be difficult for the user to detect differences in color coordinate distortions in video.

As seen from above, the second exemplary embodiment of the present invention has the effect of providing a driving method for an organic light emitting display device which can reduce power consumption by reducing the amount of selected data signals to be used for white color coordinate correction by image analysis in a display panel comprising RGBW subpixels. Moreover, the present invention has the effect of providing a driving method for an organic light emitting display device which can convert data signals so that power consumption is reduced when displaying video and when representing low gray levels.

What is claimed is:

1. An optical compensation method for an organic light emitting display device, the method comprising:

setting initial gain values of red (R), green (G), and blue (B) subpixels;

making each of the R, G and B subpixels converge on a target luminance for each subpixel;

wherein the making each of the R, G, and B subpixels converge on the target luminance comprises:

measuring color coordinates of each of the R, B, and B subpixels to which the initial gain values are applied;

calculating a luminance ratio of the R, G, and B subpixels; and adjusting maximum gains of the R, G, and B subpixels;

selecting subpixels to emit light with a white (W) subpixel from the R, G and B subpixels, and setting an initial gain value of the W subpixel;

measuring color coordinates and a luminance of the W subpixel to which the initial gain value is applied;

calculating a luminance ratio of the W subpixel and the selected subpixels;

adjusting maximum gains of the W subpixel and the selected subpixels;

measuring maximum color coordinates and a maximum luminance ratio of the W subpixel and the selected subpixels; and making the W subpixel and the selected subpixels converge on target color coordinates and luminance.

2. The method of claim 1, wherein, in the converging of the W subpixel and the selected subpixels on the target color coordinates and luminance, responsive to the W subpixel and the selected subpixels diverging from the target color coordinates and luminance, the process subsequent to the adjusting of maximum gains of the W subpixel and the selected subpixels is repeated.

3. The method of claim 1, wherein, upon completion of the W subpixel and the selected subpixels converging on the target color coordinates and luminance, calculating of the luminance ratio the W subpixel and the selected subpixels, adjusting of gains of the W subpixel and the selected subpixels for each point, and measuring of per-point gamma curve luminance for each of the W subpixel and the selected subpixels are performed, and responsive to the per-point gamma curve luminance of each of the W subpixel and the selected subpixels diverging from the target color coordinates and luminance, the process subsequent to the adjusting of gains of the W subpixel and the selected subpixels for each point is repeated.

4. The method of claim 1, wherein the setting of initial gain values of R, G and B subpixels comprises setting initial gain values of the selected subpixels.

5. The method of claim 1, wherein the making of each of the R, G and B subpixels converge on the target luminance comprises:

measuring a maximum luminance of each of the R, G and B subpixel, and responsive to each of the R, G and B subpixels diverging from the target luminance, repeating the process subsequent to the adjusting of maximum gains of the R, G and B subpixels.

6. The method of claim 1, wherein, upon completion of the R, G and B subpixels converging on target color coordinates and the target luminance, calculating of the luminance ratio the R, G and B subpixels, adjusting of gains of the R, G and B subpixels for each point, and measuring of the per-point gamma curve luminance for each of the R, G and B subpixels are performed, and when the per-point gamma curve luminance of each of the R, G and B subpixels diverge from the target color coordinates and luminance, the process subsequent to the adjusting of gains of the R, G and B subpixels for each point is repeated.

7. The method of claim 1, wherein a number of selected subpixels is one, two, or three selected from the R, G and B subpixels.

8. The method of claim 1, wherein the selected subpixels are selected from one of: the G and B subpixels, the R and G subpixels, and the R and B subpixels.

9. A driving method for an organic light emitting display device, the method comprising:

analyzing an input image to detect whether the input image is video or a still image;

responsive to detecting that the input image is video:

analyzing an amount of white (W) data signal included in the input image compared to a threshold value;

determining an amount of data signals selected from red (R), green (G) and blue (B) data signals according to an analysis result of the amount of W data signal, wherein the amount of selected data signals is determined to be increased or decreased relative to a reference amount;

responsive to detecting that the input image is a still image:

determining an amount of selected data signals to be the reference amount corrected with the target color coordinates for white gray level;

applying the amount of selected data signals to generate R, G, B and W data signals and outputting the R, G, B and W data signals; and displaying the image by using the R, G, B and W data signals.

10. The method of claim 9, further comprising, responsive to detecting that the input image is a still image applying the reference amount to the amount of selected data signals and outputting R, G, B and W data signals.

11. The method of claim 9, wherein, in the determining of the amount of selected data signals, responsive to the amount of W data signal being less than a threshold value, the amount of selected data signals is decreased compared to a reference amount, and responsive to the amount of W data signal being greater than the threshold value, the amount of selected data signals is increased compared to the reference amount.

12. The method of claim 9, wherein the amount of selected data signals has a larger reduction compared to a reference amount when the image corresponding to video has a lower gray level.

13. The method of claim 9, wherein a number of selected data signals is one, two, or three selected from the R, G and B data signals.

14. The method of claim 9, wherein the selected data signals are selected from one of: the G and B data signals, the R and G data signals, and the R and B data signals.

* * * * *